United States Patent [19]

Sherman

[11] 4,123,318

[45] Oct. 31, 1978

[54] THREE-VESSEL TREATMENT SYSTEM

[75] Inventor: Michael I. Sherman, Glens Falls, N.Y.

[73] Assignee: Kamyr, Inc., Glens Falls, N.Y.

[21] Appl. No.: 701,037

[22] Filed: Jun. 29, 1976

[51] Int. Cl.[2] ..... D21C 7/10

[52] U.S. Cl. ..... 162/19; 162/42; 162/45; 162/60; 162/237; 162/242; 162/249

[58] Field of Search ..... 162/19, 41, 42, 43, 162/44, 45, 60, 237, 242, 246, 249, 52

[56] References Cited

U.S. PATENT DOCUMENTS

| | | | |
|---|---|---|---|
| 2,789,051 | 4/1957 | Obenshain | 162/19 |
| 3,130,119 | 4/1964 | Carlsmith | 162/246 |
| 3,237,773 | 3/1966 | Laakso | 162/60 |
| 3,578,554 | 5/1971 | Richter | 162/246 |
| 4,002,528 | 1/1977 | Laakso | 162/19 |

FOREIGN PATENT DOCUMENTS

| | | | |
|---|---|---|---|
| 2,361,627 | 6/1974 | Fed. Rep. of Germany | 162/237 |
| 2,439,077 | 3/1975 | Fed. Rep. of Germany | 162/19 |

*Primary Examiner*—S. Leon Bashore
*Assistant Examiner*—William F. Smith
*Attorney, Agent, or Firm*—Cushman, Darby & Cushman

[57] ABSTRACT

An apparatus and method for the treatment of cellulosic fiber material with maximum efficiency while minimizing capital costs. Fiber material entrained in digesting liquid is impregnated with the liquid in an impregnation vessel, sluiced to a separate digesting vessel, and from the digesting vessel sluiced to one or more separate washing vessels without a significant reduction in pressure. Countercurrent washing is effected in the washing vessel(s). Digesting liquid withdrawn from the digesting vessel is heated in a transfer line back to the impregnation vessel.

4 Claims, 2 Drawing Figures

THREE-VESSEL TREATMENT SYSTEM

BACKGROUND AND SUMMARY OF THE INVENTION

The invention relates to a method and apparatus for the continuous treatment of cellulosic fiber material in three separate vessels, a first vessel for impregnation of the fiber material with digesting liquid, a second vessel for the digestion of the fiber material, and a third vessel for washing of the fiber material.

In the past, the digestion and washing of fiber material in separate vessels has been known (such as shown in U.S. Pat. Nos. 2,870,009, 2,999,785, and 3,298,209), however in such prior art devices the digested chips have been subjected to a significant pressure drop before washing thereof, which usually results in the disintegration of the chips into fiber and makes countercurrent washing thereof very difficult. According to the present invention, the digested chips are transferred from the digesting vessel to the washing vessel without significantly dropping the pressure so that no disintegration of the chips occurs, and countercurrent washing thereof is practical.

There have also been previous provisions for separate vessel impregnation and digestion-washing, such as shown in U.S. Pat. No. 3,802,957 and in copending commonly assigned application Ser. No. 698,125 filed June 21, 1976 by Michael I. Sherman and James R. Prough, and entitled "Two-Stage Digestion with Between Vessel Heating."

In U.S. Pat. No. 3,802,956, the impregnated chips are "blown" into the separate digesting-washing vessel, which results in numerous disadvantages over the apparatus and method of the present invention, and that shown in the above-mentioned copending application, wherein the chips-liquid mixture is sluiced into the digester from the impregnating vessel. Also, according to the present invention (as in the above-mentioned copending application) the transfer loop between the impregnating vessel and the digester is the heating loop, whereby intimate heating and mixing occur resulting in a more uniform final product. The present invention has numerous advantages over that disclosed in the above-mentioned copending application in overall economy and efficiency of treatment. The provision of three separate vessels means that they all can be shop fabricated. In most present installations, because of the size of the digester-washer, it is necessary to erect it in the field since it is too large to ship, resulting in increased costs over shop fabrication thereof. Also, according to the present invention each vessel may be sized to an optimum diameter for the particular operation that will be taking place therein rather than reaching a compromise for one or two vessel systems wherein the diameters have to suit all purposes. Obviously this increases treatment efficiency. This may be facilitated by the provision of two countercurrent washers in parallel. Also, the capacity of existing installations could easily be significantly increased according to the present invention merely by providing a separate washing vessel and utilizing the existing vessel for increased impregnation and/or cooking capacity.

According to the present invention, the method of treating cellulosic fiber material utilizing first, second, and third separate vertical treatment vessels is provided, the method comprising the steps of continuously feeding cellulosic fiber material entrained in liquid into a top portion of the first vessel, establishing a first flow path of cellulosic fiber material entrained in and impregnated with treatment liquid from the bottom portion of the first vessel to a top portion of the second vessel, liquid substantially filling the second vessel, establishing a column of fiber material in the second vessel below the level of liquid in the second vessel, withdrawing liquid from the top portion of the second vessel, establishing a second flow path of the liquid withdrawn from the second vessel back towards the bottom portion of the first vessel, heating the liquid during transport in the second flow path, feeding a portion of the heated liquid flowing in the second flow path into the first path, while feeding the rest of the heated liquid to a bottom portion of the first vessel, withdrawing fiber material from the bottom of the second vessel and feeding it in a third flow path, without significant reduction of the pressure thereof, to the top of the third vessel, effecting countercurrent washing of the fiber material in the third vessel, and withdrawing washed pulp from the bottom of the third vessel. The withdrawal of liquid from the top portion of the second vessel is preferably accomplished without screening, a "stilling well" being provided at the top of the second vessel, and also the stilling well principle is used for withdrawing digesting liquid from the top portion of the third vessel and establishing a fourth flow path of a portion of the liquid withdrawn from the third vessel from the third vessel back toward the bottom portion of the second vessel, and feeding a portion of the liquid flowing in the fourth flow path into the third flow path, while feeding the rest of the liquid in the fourth flow path to a bottom portion of the second vessel. A portion of the liquid withdrawn from the top portion of the third vessel is also subjected to a large pressure reduction so that a portion thereof flashes into steam, and the spent digesting liquid is removed from the pressure reduction area for ultimate recovery or disposal thereof while the flash steam is returned to a steaming vessel utilized for feeding chips to the first (impregnation) vessel. A countercurrent flow of digesting liquid in the first (impregnation) vessel may be provided (displacement impregnation), and withdrawal of liquid from the first vessel to effect a countercurrent treatment may be accomplished without screening, a "stilling well" being provided in an enlarged bottom portion of the vessel. Also, an enlarged bottom portion of the second, digesting, vessel may be provided and a portion of liquid withdrawn from a "stilling well" portion thereof and passed to a flash tank or the like, whereby the temperature and the bottom of the digester is kept low enough so that no degradation of the pulp takes place.

According to the apparatus of the present invention, apparatus for the treatment of cellulosic fiber materials comprises a first vertical treatment vessel, a separate second vertical treatment vessel which is substantially liquid filled, a separate third vertical treatment vessel which is substantially liquid filled, means for feeding cellulosic fiber material entrained in treatment liquid to the top portion of the first vessel, means for establishing a first flow path of cellulosic fiber material entrained in and impregnated with treatment liquid from the bottom portion of the first vessel to the top portion of the second vessel, a column of fiber material being established in the second vessel below the level of liquid in the second vessel, means for establishing the second flow path of liquid withdrawn from the top portion of the second vessel back toward the bottom of the first vessel, means for heating the liquid in the second flow path, means for feeding a portion of the heated liquid in the second flow path into the first flow path while feeding the rest of the heated liquid to the bottom portion of the first vessel (the bottom of the first vessel providing a heating chamber), means for withdrawing fiber material from the bottom of the second vessel and feeding it in a third flow path, without significant reduction of the pressure thereof, to the top of the third vessel, means for effecting countercurrent washing of the fiber material in the third vessel, and means for withdrawing washed pulp from the bottom of the third vessel. Inter-mixing and heating of the liquid and entrained fiber material before the fiber material is fed into the top of the second vessel is accomplished according to the present invention, and an economic, efficient structure results for the digesting and washing of cellulosic fiber material. A fourth vertical treatment vessel may also be provided, the third and fourth vessels being connected in parallel in the third flow path with the bottom of the second vessel, and means for effecting countercurrent washing of fiber material in the fourth vessel being provided. Such an arrangement allows for optimization of the relative diameters in the impregnation, cooking, and washing vessels. Preferably, when liquid is withdrawn from the top portions of the second or third vessels, or when liquid is withdrawn from the first vessel to effect countercurrent treatment in the first vessel, a "stilling well" is provided so that the liquid may be withdrawn without screening.

The primary object of the present invention is to provide a method and apparatus for effecting efficient digestion and washing of cellulosic fiber material to provide a pulp of uniform quality in the most economic manner. This and other objects of the invention will become apparent from an inspection of the detailed description of the invention and from an inspection of the appended claims.

DETAILED DESCRIPTION OF THE INVENTION

Figure 1:
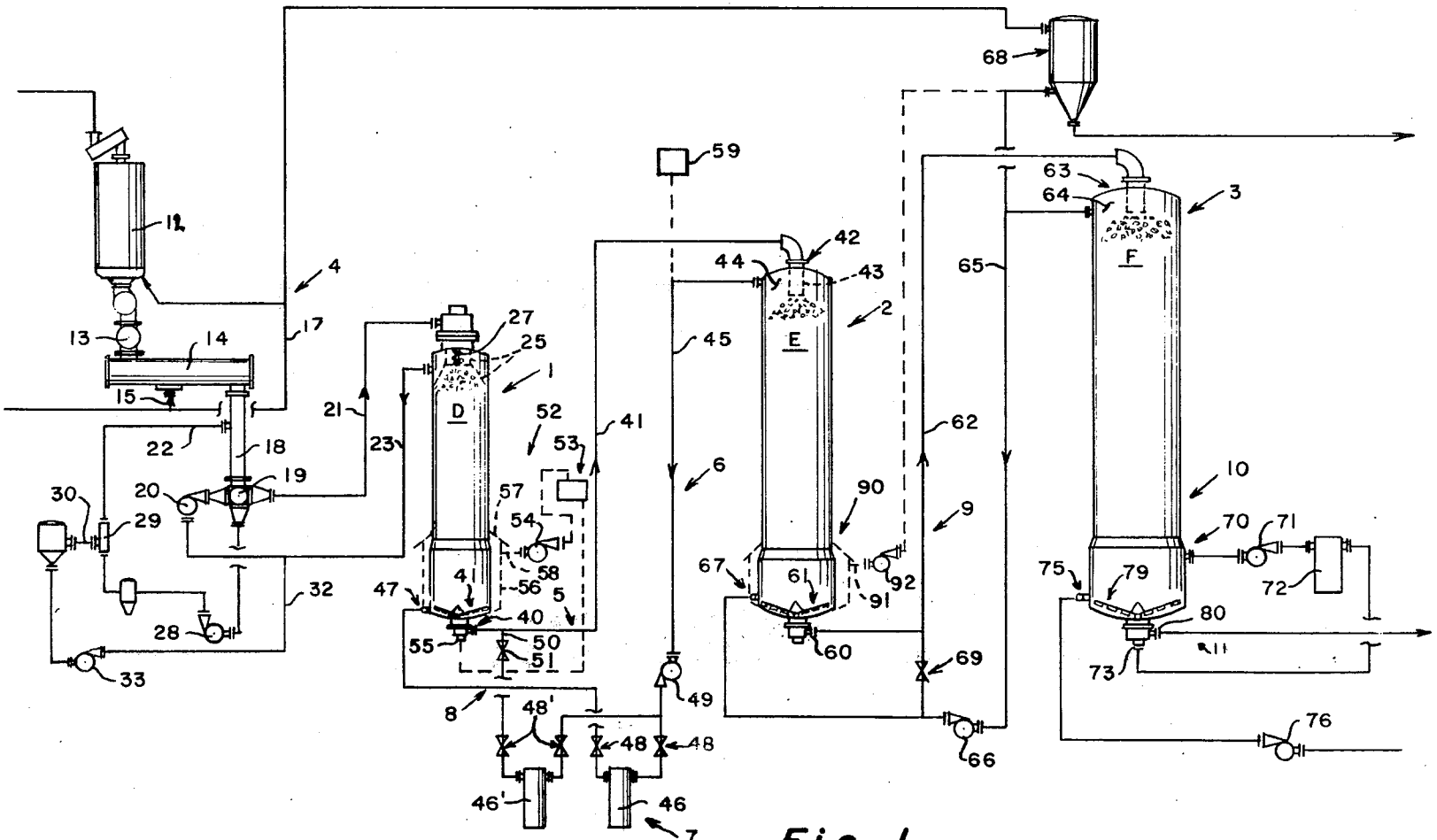
FIG. 1 is a schematic showing of exemplary apparatus according to the present invention.
Figure 2:
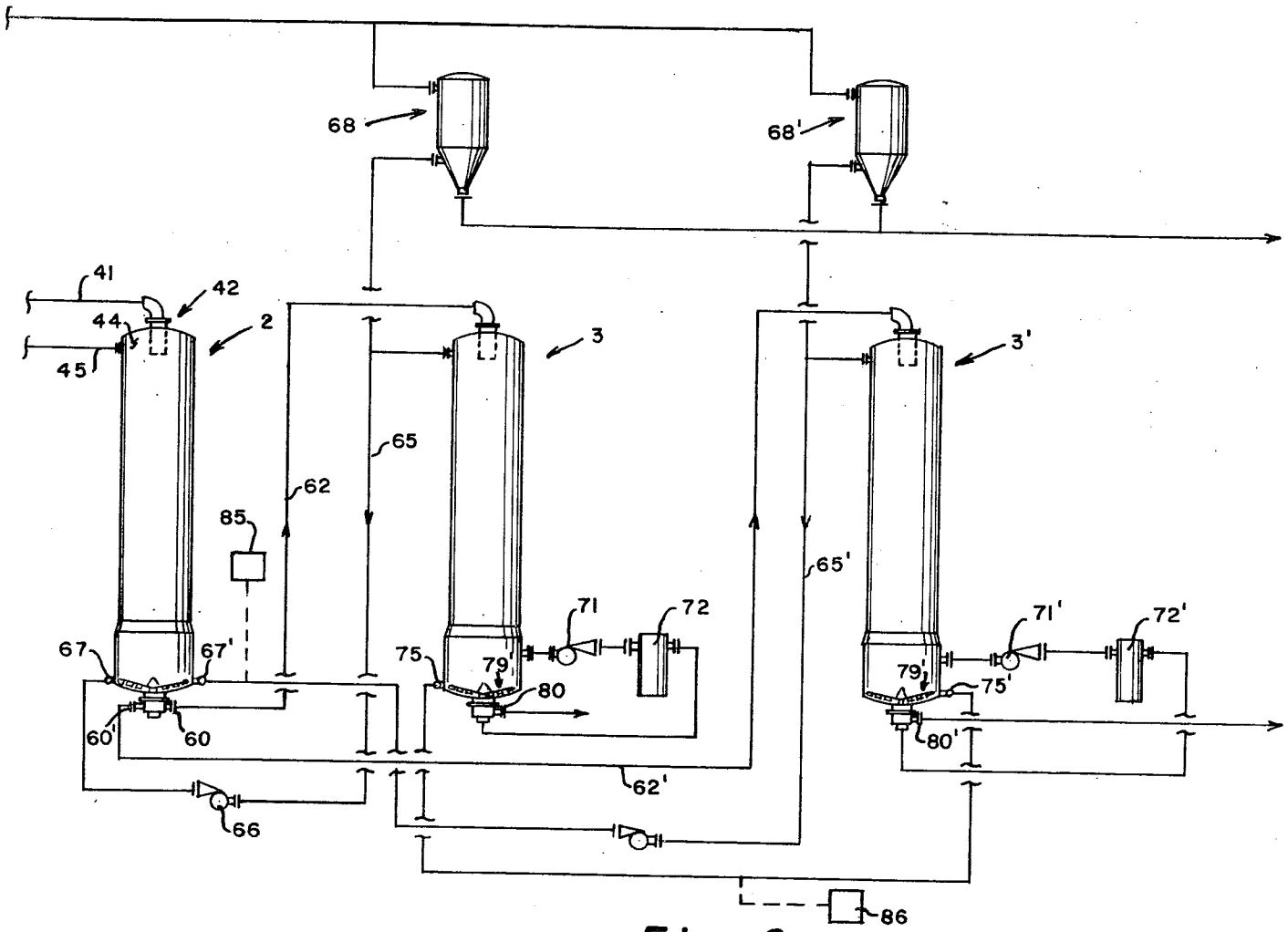
FIG. 2 is a schematic showing of a modification of the apparatus of FIG. 1 with components identical to those of the FIG. 1 apparatus cut away.

Exemplary apparatus for practicing the method according to the present invention is shown schematically in FIGS. 1 and 2. The apparatus for the digestion of cellulosic fiber material generally includes a first vertical treatment vessel (impregnation vessel) 1 having top and bottom portions, a second vertical treatment vessel (cooking vessel) 2 separate from said first vessel and having top and bottom portions, and being substantially liquid filled, a third vertical treatment vessel (wash vessel) 3 separate from said first and second vessels and having top and bottom portions, and being substantially liquid filled, means 4 for feeding cellulosic fiber material entrained in treatment liquid to the top portion of the first vessel 1, means 5 for establishing a first flow path of cellulosic fiber material entrained in an impregnated with treatment liquid from the bottom portion of the first vessel 1, to the top portion of the second vessel 2, a column E of fiber material being established in the second vessel 2 below the level of liquid in the second vessel 2, means 6 for establishing a second flow path of liquid withdrawn from the top portion of the second vessel 2 back toward the bottom portion of the first vessel 1, means 7 for heating the liquid in the second flow path, means 8 for feeding a portion of the heated liquid flowing from the heating means in the second flow path into the first flow path (5) while feeding the rest of the heated liquid to the bottom portion of the first vessel 1, means 9 for withdrawing fiber material from the bottom portion of the second vessel and feeding it in a third flow path, without significant reduction of the pressure thereof, to the top of the third vessel 3, means 10 for effecting countercurrent washing of the fiber material in the third vessel 3, and means 11 for withdrawing washed pulp from the bottom of the third vessel 3. Optionally, a fourth vertical treatment vessel—a second wash vessel 3'—may be provided in parallel with the wash vessel 3 for effecting countercurrent washing of fiber material from the digesting vessel 2.

The means 4 for feeding cellulosic fiber material entrained in treatment liquid to the top portion of the first vessel 1 preferably includes a chips bin 12 containing cellulosic fiber material therein (the cellulosic fiber material may be wood chips, straw, bagasse, reed, sawdust, or other cellulosic plant materials), rotary low pressure valve 13, a steaming vessel 14, a conduit 15 for supplying low pressure steam (e.g., one atmosphere over pressure) to the vessel 14 and the conduit 17 connected to the conduit 15 and to a source of low pressure steam. From the steaming vessel 14, the cellulosic fiber material leads to a conduit 18, treatment (digesting) liquid being supplied to the fiber material in conduit 18 by line 22. The fiber material then flows into conventional high pressure transfer valve 19, having a rotor with pockets therein turning in a stationary casing to provide boosting of the pressure of the flow in which the chips or the like are entrained. Circulating liquid pressurized by the pump 20 entrains the fiber material in transfer valve 19, and the fiber material entrained in treatment liquid flows through conduit 21 to the top portion of first (impregnation) treatment vessel 1, a line 23 leading from the top of the treatment vessel 1 back to the pump 20. A strainer girdle 25 is provided in the top of the vessel 1, to provide for withdrawal of liquid from the top portion of the vessel 1 and recirculation thereof through line 23. A feeding screw 27 disposed at the top portion of vessel 1 feeds the fiber material into the vessel 1 to establish a fiber column D (which may be monitored by a level control). A pump 28 is disposed in the low pressure line leading from transfer valve 19 back through the straining means 29 to line 22 which feeds liquid to the conduit 18. A portion of the liquid flowing through this loop is removed by the straining means 29 through conduit 30, this liquid either passing to recovery or passing into line 32 under the influence of pump 33, and ultimately back into the line 23.

Impregnation takes place in first vertical treatment vessel 1; the impregnation may take place by conventional methods, or displacement impregnation may be effected. Displacement impregnation is more fully discussed in commonly assigned copending application, Ser. No. 719,656 filed Sept. 1, 1976 by James R. Prough and entitled "Displacement Impregnation" now U.S. Pat. No. 4,071,399. The impregnated cellulosic fiber material passes into means 5, and then ultimately to second (digesting) treatment vessel 2. The means 5 for establishing a first flow path include an outlet 40 disposed at the bottom of the vessel 1, a conventional rotating scraper 41 disposed within the vessel 1 at the without significant reduction in the pressure thereof, and establishing the column F, countercurrent washing of the fiber material in the third vessel 3 may be provided by the means 10. The means 10 preferably includes an outlet 70 for withdrawing wash liquid from the vessel 3 at an intermediate point along the vessel 3, under the influence of pump 71, heating the liquid in wash heater 72, and returning the liquid to an inlet 73 disposed at the bottom of vessel 3, the liquid being re-introduced into the vessel 3 with an upwardly directed velocity component. Fresh washing liquid is fed to the wash vessel 3 through the inlet 75 under the influence of cold blow pump 76. The washing liquid flows upwardly in the vessel 3, countercurrent to the downwardly flowing fiber material in the column F, and spent washing liquid is withdrawn through chamber 64 along with the spent digesting liquid. The means 11 for withdrawing wash pulp from the bottom of the third vessel 3 may include a conventional rotary scraper 79, cooperating with a conventional pulp outlet 8.

The apparatus shown in FIG. 2 is substantially the same as that in FIG. 1 (a first vessel 1 and associated means being provided therewith which is substantially identical to that shown in FIG. 1), except that instead of providing a single enlarged wash vessel 3, a pair of wash vessels 3, 3′ are provided connected in parallel with the digester 2. As shown in FIG. 2, the wash vessels 3, 3′ may be made the same size as the digester 2 so that by making all vessels the same size, greater economy may be effected. This also facilitates, utilizing the existing vessel for increased impregnation and/or cooking capacity while wash vessels of substantially the same size as the existing vessel are provided. A pair of outlets 60, 60′ are provided at the bottom of the digester 2, the outlet 60 connected to conduit 62 leading to the top of wash vessel 3, and the conduit 62′ being connected to the top of wash vessel 3′. A pair of inlets 67, 67′ are provided in the bottom of vessel 2 cooperating with lines 65 and 65′, respectively. Inlets 75, 75′ are provided for wash vessels 3, 3′, respectively for introducing fresh washing liquid therein. As shown in dotted line in FIG. 2, a source 85 of fresh digesting liquid may be provided for lines 65, 65′, and a source 86 for fresh digesting liquid may be provided for inlets 75, 75′. Of course such sources 85, 86 may also be provided in the FIG. 1 embodiment of the apparatus according to the present invention.

Also, in order to keep the temperature at the bottom of digester 2, low enough (in both FIGS. 1 and FIGS. 2), to prevent pulp degradation an enlarged bottom portion 90 (see dotted lines in FIG. 1) thereof may be provided, and liquid withdrawn therefrom through line 91 by pump 92 and passed to flash tank 68. This removal, utilizing a "stilling well," is essentially the same as described with respect to 52 above.

According to the method of treating cellulosic fiber material according to the present invention, cellulosic fiber material entrained in treatment liquid is fed into a top portion of the first (impregnation) vessel 1—from chips bin 12, pre-steaming vessel 14, high pressure transfer valve 19, and feed screw 27—to establish a column D of fiber material in the vessel 1. Displacement impregnation of the fiber material takes place in the vessel 1, and a first flow path 5 is established for cellulosic fiber material entrained in and impregnated with treatment (digesting) liquid from the outlet 40 in the bottom portion of the vessel 1 to the top 42 of vessel 2, liquid substantially filling the second vessel 2. A column E of fiber material is established in the second vessel 2, below the level of liquid in the second vessel 2, and liquid is withdrawn from the top portion (chamber 44) of the second vessel 2. A second flow path 6 is established for the liquid withdrawn from the second vessel 2 back toward a bottom portion of the first vessel 1, and heating of the liquid by heater 46 takes place during transport of the liquid in the second flow path 6. A portion of the heated liquid flowing in the second flow path 6 is fed—through valve 59 in conduit 60—to conduit 41 of the first flow path 5, while the rest of the heated liquid is fed into the inlet 47 in the bottom of the first vessel 1. Digested fiber material is withdrawn from the bottom of the second vessel 2 through conduit 62 and is fed in a third flow path defined by the conduit 62, without significant reduction of the pressure thereof, to the top 63 of the third vessel 3. Countercurrent washing of the fiber material in the third vessel 3 is effected by the inlets 73 for introducing washing liquid with an upward velocity component into the vessel 3, washing liquid from inlet 75, and the withdrawal and heating means 70, 72. Washed pulp is withdrawn from the outlet 80 in the bottom of the wash vessel 3, the withdrawal being facilitated by the rotating scraper 79. A fourth vessel may be provided, the method there comprising the further step of feeding the fiber material entrained in liquid in the third flow path both to the third and fourth vessels, the vessels being arranged in parallel, and also effecting countercurrent washing of the fiber material in the fourth vessel. Also, preferably digesting liquid is withdrawn from the top portion of the third vessel, a portion of the withdrawn liquid is subjected to a large pressure reduction in a pressure reduction area, so that a portion thereof flashes into steam, and spent digesting liquid is removed from the pressure reduction area for ultimate recovery or disposal thereof. A fourth flow path is established with a portion of the liquid withdrawn from the third vessel and not fed to the pressure reduction area, from the third vessel back toward a bottom portion of the second vessel, and a portion of the liquid flowing in the fourth flow path is fed into the third flow path while feeding the rest of the liquid in the fourth flow path to a bottom portion of the second vessel. Countercurrent treatment of the fiber material in the impregnation vessel also may be provided.

It will thus be seen that according to the present invention a method and apparatus have been provided which allow efficient and economical treatment of cellulosic fiber material without many of the drawbacks of prior art methods and apparatus. While the invention has been herein shown and described in what is presently conceived to be the most practical and preferred embodiment, it will be obvious to those of ordinary skill in the art that many modifications may be made thereof within the scope of the invention, which scope is to be accorded the broadest interpretation of the appended claims so as to encompass all equivalent structures and methods.

What is claimed is:

1. A method of treating cellulosic fiber material utilizing a first vessel, s separate second, digesting vessel, and a separate third vessel, said method comprising the steps of continuously (a) feeding cellulosic fiber material entrained in treatment liquid into a top portion of the first vessel, (b) establishing a first flow path of cellulosic fiber material entrained in and impregnated with treatment liquid from a bottom portion of the first vessel bottom thereof for forcing fiber material entrained in treatment liquid into the outlet 40, a conduit 41 extending from the outlet 40 to the top of the second treatment vessel 2, and means 43 at the top of the second vessel 2 for introducing the fiber material into the vessel 2 and establishing a column E in the vessel 2. The means 42 can include any suitable feeding means, however, it is preferred that it include a tube 43, the column of fiber material in the second vessel being established below the bottom of the tube 43, so that screenless withdrawal of treatment liquid from the top area 44 of the vessel 2 above the column E may be provided. A "stilling well" is provided by chamber 44. Apparatus for accomplishing such screenless liquid withdrawal is shown in more detail in U.S. patent application Ser. Nos. 592,659, filed July 2, 1975 now U.S. Pat. No. 4,028,171; 659,638, filed Feb. 20, 1976 now U.S. Pat. No. 4,061,193; and 685,391, filed May 11, 1976, the disclosure of which is hereby incorporated by reference in the present application. The means 6 for establishing a second flow path may include conventional screens (not shown) for withdrawing liquid through the top of the vessel 2, however, it is preferred that screenless withdrawal be provided—as described above—by providing the withdrawal conduit 45 at a portion of the vessel 2 in chamber 44 above the column E of fiber in the vessel 2. A pump 49 disposed in the second flow path 6 provides suction for the withdrawal of liquid, and conduit 45 passes through heating means 7 to an inlet 47 at the bottom of impregnation vessel 1. Since the liquid that flows through 47 into the bottom of the first treatment vessel 1 is heated, a heating chamber A for heating fiber material is provided at the bottom of vessel 1.

The heating means 7 in second flow path 6 may include any conventional direct or indirect heating means, the temperature of the heating means 7 being controlled to provide digesting liquor of a given temperature in the first and second flow paths. Such heating means may include a first heater 46, connected in parallel with an auxiliary heater 46', valves 48 and 48' respectively being associated with heaters 46, 46'. Normally valves 48 are open and liquid flows through path 6, under the influence of pump 49, through heater 46, and then to inlet 47. When it is desired to provide routine maintenance for heater 46, valves 48 are closed, and valves 48'—which are normally closed—are opened, whereby auxiliary heater 46' is inserted in the second flow path 6 rather than the primary heater 46.

The means 8 for feeding the portion of heated liquid flowing in the second flow path 6 into the first flow path 5, while feeding the rest of the heated liquid to the inlet 47 in the bottom of the first vessel 1, preferably comprises an adjustable valve 51 diposed in a conduit 50, extending between conduits 45 and 41. The position of the valve 51 may be adjusted by manual means, or may be responsive to the flow in the lines 45 and 41.

As shown in dotted line at 52 in FIG. 1, means for establishing a fifth flow path of treatment liquid from a lower portion of the first vessel back into the first vessel to establish a countercurrent flow of liquid upwardly in the first vessel may be provided, a heater 53 being disposed in the fifth flow path, and a pump 54 withdrawing liquid from the impregnation vessel 1 to circulate it to the inlet 55 at the bottom of impregnation vessel 1, for establishing the countercurrent flow treatment. The first vessel 1 may have an enlarged bottom portion 56 thereof, the fiber material being fed from the first vessel 1 into enlarged bottom portion 56 at a point below the top 57 of the enlarged bottom portion 56, an outlet 58 being provided as part of the means for establishing the fifth flow path, the outlet 58 being provided above the level of fiber material in the enlarged bottom portion 56 of the first vessel 1, so that no screening of the withdrawn treatment liquid need be provided.

A source 59 of fresh treatment (digesting) liquid may also be provided connected to line 45. Alternatively, the source 59 may be connected to line 32 instead of line 45 if conventional impregnation is to be effected in vessel 1 rather than displacement impregnation.

The first treatment vessel 1, the first treatment vessel feeding means 4, the means 5 for establishing the first flow path, the means 6 for establishing a second flow path, the heating means 7, and the means 8 for feeding a portion of the heated liquid flowing in the second flow path 6 into the first flow path 5 while feeding the rest of the heated liquid to the first vessel 1, are substantially the same as the apparatus described in copending application Ser. No. 698,125 filed June 21, 1976 by Michael I. Sherman and James R. Prough, entitled "Two-Stage Digestion with Between Vessel Heating." The apparatus to be hereinafter described in detail leads to the advantages according to the present invention over the apparatus and method described in the above-mentioned copending application.

The second treatment vessel 2 (the cooking vessel) has an outlet 60 disposed at the bottom thereof forming part of the means 9 for withdrawing fiber material from the bottom of the second vessel, a conventional rotating scraper 61 and a conduit 62 also being provided as part of said means 9. The means 9 also includes an inlet 63 at the top of third treatment vessel (washing vessel) 3, for treating digested fiber material in a third flow path defined by the conduit 62 into the top of the third treatment vessel 3 without significant reduction of the pressure. A fiber column F is established in the wash vessel 3. Again, it is preferred that a "stilling well" 64 is provided at the top of wash vessel 3 to allow for screenless withdrawal of spent digesting liquid therefrom, although again it is understood that conventional screens could be employed. Means for withdrawing digesting liquid from the top portion of the third vessel 3 includes a conduit 65 (operatively connected to a pump 66 which leads back to an inlet 67 at the bottom of digesting vessel 2) and a flash tank 68. A portion of the spent digesting liquid withdrawn from chamber 64 is fed to the flash tank 68, the flash tank 68 being of any conventional design which effects a large pressure reduction whereby a portion of the digesting liquid is flashed into steam, and passes into line 17 back to pre-steaming vessel 14, and the rest of the spent digesting liquid is passed through line 69 to a recovery or disposal station. The portion of the digesting liquid withdrawn from the chamber 64 that is not disposed of via flash tank 68 is—as previously mentioned—led back to the inlet 67 at the bottom of the digester 2. Means 8' also may be provided (including conduit 50' and valve 51') for feeding a portion of the liquid flowing in the fourth flow path defined by the conduit 65 to the third path defined by the conduit 62 for facilitating high pressure transfer of the digested fiber material through the line 62 to the top of wash vessel 3.

The wash vessel 3—as shown schematically in the drawings—may have a diameter significantly different than that of the cooking and impregnation vessels to effect optimal treatment of the fiber material. Since the fiber material is fed into the vessel 3 from the vessel 2 to a top portion of the second vessel, liquid substantially filling the second vessel, (c) establishing a column of fiber material in the second vessel below the level of liquid in the second vessel, (d) withdrawing liquid from a top portion of the second vessel, (e) establishing a second flow path of the liquid withdrawn from the second vessel back toward a bottom portion of the first vessel, (f) heating the liquid during transport said second flow path, (g) feeding a portion of the heated liquid flowing in the second flow path into said first flow path, while feeding the rest of the heated liquid to a bottom portion of the first vessel, (h) withdrawing fiber material from the bottom of the second vessel and feeding it in a third flow path, without significant reduction of the pressure thereof, to the top of the third vessel, (i) maintaining the temperature in the bottom of the second vessel low enough to prevent pulp degradation by providing an enlarged portion of said second vessel bottom, withdrawing liquid from the enlarged bottom portion of the second vessel, subjecting a portion of the withdrawn liquid to a large pressure reduction in a pressure reduction area so that a portion thereof flashes into steam and the rest remaining as liquid, and removing this liquid from the pressure reduction area for ultimate recovery or disposal thereof and removing the flashed steam from the pressure reduction area for ultimate reuse thereof, (j) effecting countercurrent washing of the fiber material in the third vessel, (k) withdrawing washed pulp from the bottom of the third vessel, (l) withdrawing liquid from the top portion of the third vessel, (m) subjecting a portion of the withdrawn liquid to a large pressure reduction in a pressure reduction area so that a portion thereof flashes into steam and the rest remaining as liquid, (n) removing this liquid from the pressure reduction area for ultimate recovery or disposal thereof and removing the flashed steam from the pressure reduction area, (o) establishing a fourth flow path of a portion of the liquid withdrawn from the third vessel and not fed to the pressure reduction area from the third vessel and back toward a bottom portion of the second vessel, and (p) feeding a portion of the liquid flowing in said fourth flow path into the third flow path while feeding the rest of the liquid in the fourth flow path to a bottom portion of the second vessel.

2. A method as recited in claim 1 wherein said step of effecting countercurrent washing of fiber material in the third vessel is accomplished by feeding washing liquid into a bottom portion of the third vessel, withdrawing washing liquid from an intermediate portion of the third vessel, heating the withdrawn washing liquid, and feeding the withdrawn heated liquid into the bottom of the third vessel with an upwardly directed velocity component.

3. A method as recited in claim 1 wherein a column of fiber material is established in the third vessel below the level of liquid in the third vessel, which third vessel is substantially filled with liquid, and wherein said step of withdrawing liquid from the top portion of the third vessel is accomplished by withdrawing liquid from above the level of the fiber column in the third vessel without screening the liquid.

4. A method as recited in claim 1 wherein a fourth vessel is provided and comprising the further steps of feeding the fiber material entrained in liquid in the third flow path both to the third and fourth vessels, the vessels being arranged in parallel, and effecting countercurrent washing of the fiber material in the fourth vessel.

* * * * *